US009709327B2

(12) United States Patent
Marchiori

(10) Patent No.: US 9,709,327 B2
(45) Date of Patent: Jul. 18, 2017

(54) RAPID RESCUE OF INUNDATED CELLPHONES

(75) Inventor: David Marchiori, San Antonio, TX (US)

(73) Assignee: Dry Ventures, Inc., San Antonio, TX (US)

( * ) Notice: Subject to any disclaimer, the term of this patent is extended or adjusted under 35 U.S.C. 154(b) by 699 days.

(21) Appl. No.: 13/424,058

(22) Filed: Mar. 19, 2012

(65) Prior Publication Data

US 2015/0226481 A1 Aug. 13, 2015

Related U.S. Application Data

(60) Provisional application No. 61/453,659, filed on Mar. 17, 2011, provisional application No. 61/526,122,
(Continued)

(51) Int. Cl.
*F26B 5/04* (2006.01)
*F26B 9/06* (2006.01)
(Continued)

(52) U.S. Cl.
CPC ..... *F26B 9/06* (2013.01); *F26B 5/12* (2013.01); *F26B 9/003* (2013.01); *F26B 23/04* (2013.01); *F26B 25/16* (2013.01)

(58) Field of Classification Search
CPC ..... F26B 5/12
(Continued)

(56) References Cited

U.S. PATENT DOCUMENTS 1,854,956 A 4/1932 Reeve
3,302,303 A 2/1967 Marcel
(Continued)

FOREIGN PATENT DOCUMENTS

JP 2006019607 A 1/2006
JP 2006084878 A 3/2006
(Continued)

OTHER PUBLICATIONS

How Can I Fix My Cell Phone—It Got Wet; Sysoef, Alex; Apr. 21, 2007; www.howtospoter.com/general/how-can-i-fix-my-cell-phone-it-got-wet.

(Continued)

*Primary Examiner* — Jason Lau
(74) *Attorney, Agent, or Firm* — William H. Quirk; Jesse Frizzell; Rosenthal Pauerstein Sandoloski Agather LLP

(57) ABSTRACT

A system and method for providing fast and effective drying for inundated wireless telecommunications handsets by a combination of technologies that induce a negative pressure atmosphere together with controlled thermal energy at levels that is significant yet relatively harmless to handset components and memory. The combination is such that the embodiments generally restore full handset functionality (to the extent recoverable) within thirty minutes from activation of the particular station for treatment of an inundated handset. Related business methods of the embodiments include the derivation of revenue through licensing and marketing agreements with service center owners or the operators of other retail establishments such as courier mail centers.

18 Claims, 5 Drawing Sheets

Related U.S. Application Data filed on Aug. 22, 2011, provisional application No. 61/550,919, filed on Oct. 25, 2011.

(51) Int. Cl.

| | |
|---|---|
| ***F26B 5/12*** | (2006.01) |
| ***F26B 23/04*** | (2006.01) |
| ***F26B 25/16*** | (2006.01) |
| ***F26B 9/00*** | (2006.01) |

(58) Field of Classification Search

USPC ..... 34/412; 206/204

See application file for complete search history.

(56) References Cited

U.S. PATENT DOCUMENTS

| | | | | |
|---|---|---|---|---|
| 5,172,488 | A | 12/1992 | Okane et al. | |
| 5,376,392 | A * | 12/1994 | Ikegami et al. | 426/127 |
| 5,377,425 | A * | 1/1995 | Kawakami et al. | 34/92 |
| 5,636,446 | A * | 6/1997 | Mae | F26B 9/066 34/195 |
| 5,671,546 | A | 9/1997 | Haala | |
| 5,852,879 | A | 12/1998 | Schumaier | |
| 6,399,920 | B1 | 6/2002 | Guinn | |
| 6,625,900 | B1 | 9/2003 | Tobias | |
| 6,760,981 | B2 | 7/2004 | Leap | |
| 7,017,276 | B2 | 3/2006 | Greenspan et al. | |
| 7,182,820 | B2 | 2/2007 | Campbell et al. | |
| 7,814,678 | B2 | 10/2010 | Romanek | |
| 2003/0115768 | A1 * | 6/2003 | Hoffman | 34/92 |
| 2004/0186620 | A1 * | 9/2004 | Chirnomas | G07F 5/18 700/231 |
| 2005/0081890 | A1 | 4/2005 | Ato et al. | |
| 2005/0217136 | A1 * | 10/2005 | Blankenship et al. | 34/406 |
| 2007/0033824 | A1 * | 2/2007 | Okajima | H01L 21/67109 34/58 |
| 2007/0225863 | A1 | 9/2007 | Gross et al. | |
| 2008/0256822 | A1 * | 10/2008 | Suzuki et al. | 34/92 |
| 2009/0022434 | A1 * | 1/2009 | Chiba et al. | 383/109 |
| 2009/0077825 | A1 * | 3/2009 | Toofan et al. | 34/273 |
| 2009/0090022 | A1 * | 4/2009 | Ho et al. | 34/406 |
| 2009/0145783 | A1 * | 6/2009 | Forker | 206/204 |
| 2013/0055585 | A1 | 3/2013 | Fujiwara | |

FOREIGN PATENT DOCUMENTS

| | | | |
|---|---|---|---|
| JP | 2007027474 | A | 2/2007 |
| JP | 2008261646 | A | 10/2008 |
| JP | 2010284616 | A | 12/2010 |
| WO | 9848855 | A1 | 11/1998 |
| WO | 2011145555 | A1 | 11/2011 |

OTHER PUBLICATIONS

"How to Save a Wet Cell Phone"; WikiHow; Jul. 1, 2008; www.wikihow.com/Save-a-Wet-Cell-Phone.

"How to Save a Wet Cell Phone"; XHotmtail; Sep. 1, 2007; www.instructables.com/id/How-to-Save-a-Wet-Cell-Phone/?ALLSTEPS.

"How to Save You Wet Cell Phone-Tech Clinic"; Johnson, Joel; Jul. 1, 2008; Popular Mechanics; www.popularmechanics.com/technology/how-to/tips/4269047/.

* cited by examiner

RAPID RESCUE OF INUNDATED CELLPHONES

CLAIM OF PRIORITY TO PRIOR APPLICATION

This application claims the benefit of the filing date of U.S. Provisional Application No. 61/453,659, filed on Mar. 17, 2011, entitled "Electronic Device Dryer and Method to Dry Electronic Devices"; U.S. Provisional Application No. 61/526,122, filed on Aug. 22, 2011, entitled "Rapid Rescue of Inundated Cellphones"; and U.S. Provisional Application No. 61/550,919, filed Oct. 25, 2011, entitled "Rapid Rescue of Inundated Cellphones", the entire disclosures of which are hereby incorporated by reference into the present disclosure.

NONPUBLICATION REQUESTED

This application is a utility application under 37 CFR 1.53(b) and is submitted with an accompanying non-publication request in accordance with 35 U.S.C. §122(b). Accordingly, the subject matter of this application is to be maintained in secrecy until and unless Applicant allows a patent to issue based on this application.

BACKGROUND OF THE INVENTION

1. Field of the Invention

The present invention is directed generally to the field of flood recovery of wireless telecommunication handsets and, more particularly, to systems and methods for rescue or return to proper and complete working condition of cellphones and other handheld wireless telecommunication devices (hereafter referred to as "handsets"), after the handsets have been exposed to excessive water or other electrically-conductive liquids.

2. Description of Related Art

It is estimated that annually about twenty-five percent of all cellphone handsets in the United States are exposed to water in such amounts as to disrupt proper electronic functioning of the handsets—usually resulting in a complete loss of function of the handsets. Such overexposures of cellphone handsets to water or aqueous liquids can occur in rivers, lakes, seas, ponds, pools, toilets, sinks, buckets, aquariums, and open drink containers. The handsets may fall or be dropped into such bodies of water or be carried in by hand or in pockets, carry cases, or other carry compartments. In addition, such overexposures can occur during use of devices such as water hoses and car wash sprayers. The resulting damage to the cellphone handsets can be devastating because, in addition to complete loss of function of an expensive handset, valuable and often irreplaceable data is sometimes lost, causing frustration and loss of time while waiting and making arrangements for a replacement cellphone handset.

About three hundred million cellphone handsets are in use in the United States, and the annual hardware replacement costs to users resulting from water damage is several billion dollars without even considering service and reconnect fees or incidental costs of lost work time, lost data, and lost business opportunities.

For purposes of these descriptions, except to the extent clarified otherwise, any and all causes of such overexposures are generally referred to as "immersions," handsets that have been subject to such immersions are generally referred to as "inundated handsets," and processes for saving, salvaging, drying, restoring or remediating inundated handsets and/or data stored thereon from potential permanent loss or damage are generally referred to as "rescue" of such handsets.

Since the use of cellphone handsets became widely popular, many people have tried to find or develop safe, efficient, reliable, affordable, and fast ways of rescuing inundated handsets and associated data, but the tremendous need remains largely unsatisfied.

It is fairly well-known that inundated handset batteries should be removed as soon as possible after inundation in order to avoid further damage, and various ways have been suggested to ensure the handset electronic components are completely dry before installing new batteries, but known techniques require lengthy periods of time—usually several days to be safe. Popular rescue techniques involve towel drying, tilting and shaking out as much water as possible before placing the inundated handset in a bag or envelope together with rice or some other form of desiccant to absorb moisture for a day or two. Then the handset can be toweled, tilted, and shaken again to ensure no more water comes out before attempting to turn it on again. Others suggest also blowing or vacuuming air through the inundated handset to accelerate the drying process, such as by putting it over an air conditioning vent or by using a vacuum cleaner. However, generally suggestions to accelerate drying with some form of heat have been routinely discouraged in order to avoid causing worse damage from overheating.

Most people with inundated handsets are forced to scrap the inundated handset and start over with a new one. Victims of inundated handsets have desired a feasible alternative for many years, but known techniques to speed up the drying process are simply so risky and speculative that most victims barely even try to rescue an inundated handset. Moreover, those that do try are still advised to wait at least twenty four hours (if not several days) before risking powering up of an inundated handset. Victims might try leaving it with a service desk at their local wireless carrier store, but the prospects are too speculative to be practical, not to mention that service desks often just try the same options that the victim had, albeit at a level allowing the handset to be more disassembled in order to further aid the drying process. The result, irrespective, means a victim still has to wait for an extended period of time, while all the while there is still only a small chance for a successful rescue.

SUMMARY OF THE INVENTION

Basic objectives of the present invention are to provide a fast and effective drying system and/or method for inundated handsets. Related objectives include providing as much in a way that can be easily, reliably, rapidly and affordably enabled and used to partially or completely salvage inundated handsets and the data stored thereon. It is also an objective of the present invention to enable as much at locations convenient for end users and/or handset service personnel. Other objectives of the invention involve improving over the state of the art, and providing such systems and methods together with business methods and accommodations that will allow successful and sustainable implementation in the marketplace.

Many preferred embodiments provide solutions that are of minimal cost to the user, particularly if their use is ineffective in a given instance. Embodiments of the present invention help simplify and expedite the risky process of rapidly rescuing inundated handsets.

Through a synergistically effective and practical combination of technologies that induce a negative pressure atmosphere together with controlled thermal energy at levels that are significant yet relatively harmless to handset components and memory, a preferred embodiment goes against the teachings of the prior art to produce relatively safe and rapid drying of inundated handsets. Other embodiments incorporate mechanical actuator to repeatedly or, preferably, continuously reposition the inundated handset during the drying process in order to vary gravity's influence on any moisture remaining inside the handset while also helping to distribute the application of thermal energy more evenly to the handset. The speed of drying, in turn, renders many other aspects of the invention and the embodiments commercially feasible and practical for sustained use in the marketplace.

Some aspects of the invention are preferably hubbed around a machine that is adapted to facilitate rapid recovery of inundated handsets. Other aspects of preferred embodiments meet the objectives of the present invention through providing a basic dryer that can be easily accessed through unmanned kiosks, stations or the like that are conveniently located for use by handset owners. Some preferred embodiments utilize a self-serve drying machine that can be accessed like a vending machine or through a convenient kiosk in a mall, while others use drying machines in or in close proximity to wireless carrier service centers. Still other embodiments are adapted to be used by or with the assistance of trained handset service personnel.

Related business methods of preferred embodiments derive revenue through licensing and marketing agreements with service center owners or the operators of other retail establishments such as courier mail centers.

Through convenient access and use, some preferred embodiments help to make the handset recovery process more accessible to a greater number of handset users, thereby enabling peace of mind that an attempt to salvage the handset has been made even if the handset or its data are, in fact, irretrievable. By partnering with wireless telecommunications carriers and/or shipping services, some preferred embodiments ensure availability of a rapid-handset-drying alternative through attractive business arrangements that compensate such partners with bonus fees that increase relative to the amount of revenue-generating use for the particular handset recovery station, in addition to reasonable flat fees. Some embodiments also generate revenue through referral services and/or advertising displays that provide handset users with information about other handset options, carrier options and/or handset service options, preferably in the general vicinity of each particular handset recovery station. In addition, preferred embodiments work to educate handset users on best practices for safe and effective use of handsets.

Preferred embodiments of the present invention relate to systems and methods for rescuing inundated handsets. One particular embodiment includes a box (or station) that accessibly encloses a chamber into which the inundated handset can be placed and hermetically sealed. The box preferably includes both a vacuum pump and at least one thermal energy source for reducing the pressure and increasing the temperature, respectively, inside the hermetically sealed chamber. The thermal energy source(s) preferably include(s) an infrared heat lamp that helps heat up the atmosphere in the chamber so that the moisture in the inundated handset can be driven into the vapor phase and the vacuum pump can pump the vapor out from the chamber.

Some preferred embodiments of the invention bring together an array of technologies that combine to provide rapid and effective drying of inundated handsets that are placed in a sealed chamber within the rescue station. The combination is such that the embodiments generally restore full handset functionality (to the extent recoverable) within thirty minutes from activation of the particular station for treatment of an inundated handset. The array of combined technologies preferably includes the provision of a significantly subatmospheric pressure environment surrounding the inundated handset, together with other drying technologies. The other drying technologies preferably include at least one form of thermal energy transfer, either or both (a) infra-red radiated heating with a heat lamp or the like, to cause heating of the handset internal components to no more than a safe threshold temperature, preferably radiated from a source that is positioned at or above the elevation at which a handset would be positioned in the chamber, and (b) safe convected and/or conducted heating from a heat source located beneath the inundated handset compartment, and (c) desiccant and/or wicking technologies to accelerate removal of moisture from the drying compartment. "Safe" heating of the handsets shall be understood to mean heating of the handset at heating rates such that internal components starting at ambient temperature cannot be heated to more than a safe threshold temperature during the standard duration of treating the inundated handset. Some embodiments incorporate feedback control mechanisms in order to ensure that the combined levels of heating an inundated handset are indeed safe. Preferably, the safe maximum threshold temperature is 150 degrees Fahrenheit, although two alternative embodiments use safer maximum thresholds of 110 and 125 degrees Fahrenheit, respectively, and those of skill in the art may determine or select a different safe threshold temperature.

In this respect, before explaining more about some of the preferred embodiments of the invention, it is to be understood that the invention is not limited in its application to the details of construction and to the arrangements of the components set forth in the following descriptions or illustrated in the drawings. The invention is capable of many other embodiments and of being practiced and carried out in numerous other ways. Also, it is to be understood that the phraseology and terminology employed herein are for the purpose of the description and should not be regarded as limiting.

As controlled vacuum and multimodal heat are applied to the handset, the moisture in the handset is substantially evaporated within less than thirty minutes in most cases, and always within less than twenty-four hours. A moisture sensor is preferably used to monitor changes in relative humidity within the vacuum chamber. When the relative humidity remains below a predefined threshold, the controller concludes that the handset is then relatively safe for use and indicates as much to the user.

Many other problems, obstacles, limitations and challenges of the present invention, as well as its corresponding objectives, features and advantages, will be evident to the reader who is skilled in the art, particularly when this application is considered in light of the prior art, and it is intended that these objectives, features and advantages are within the scope of the present invention.

Figure 1:
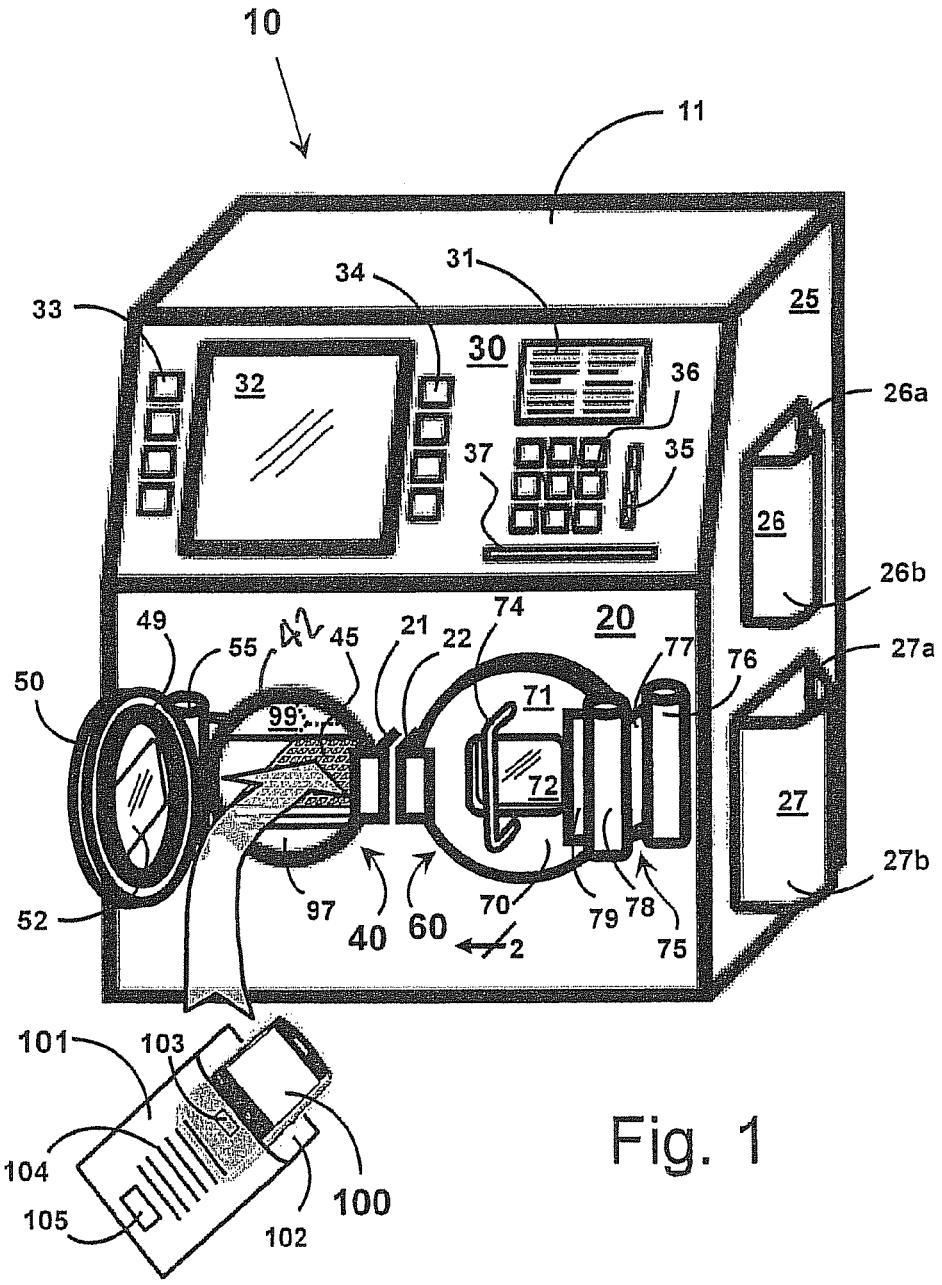
FIG. 1 is a simplified isometric perspective view of a system 10 that embodies and incorporates and uses embodiments of the present invention, for rapid rescue of inundated handsets 100.

1, with various structural elements such as chamber walls 61, 63 and 64, and door 70 shown partially in sagittal cross-section generally on the viewing perspective 2-2 referenced in FIG. 1.

Figure 2:
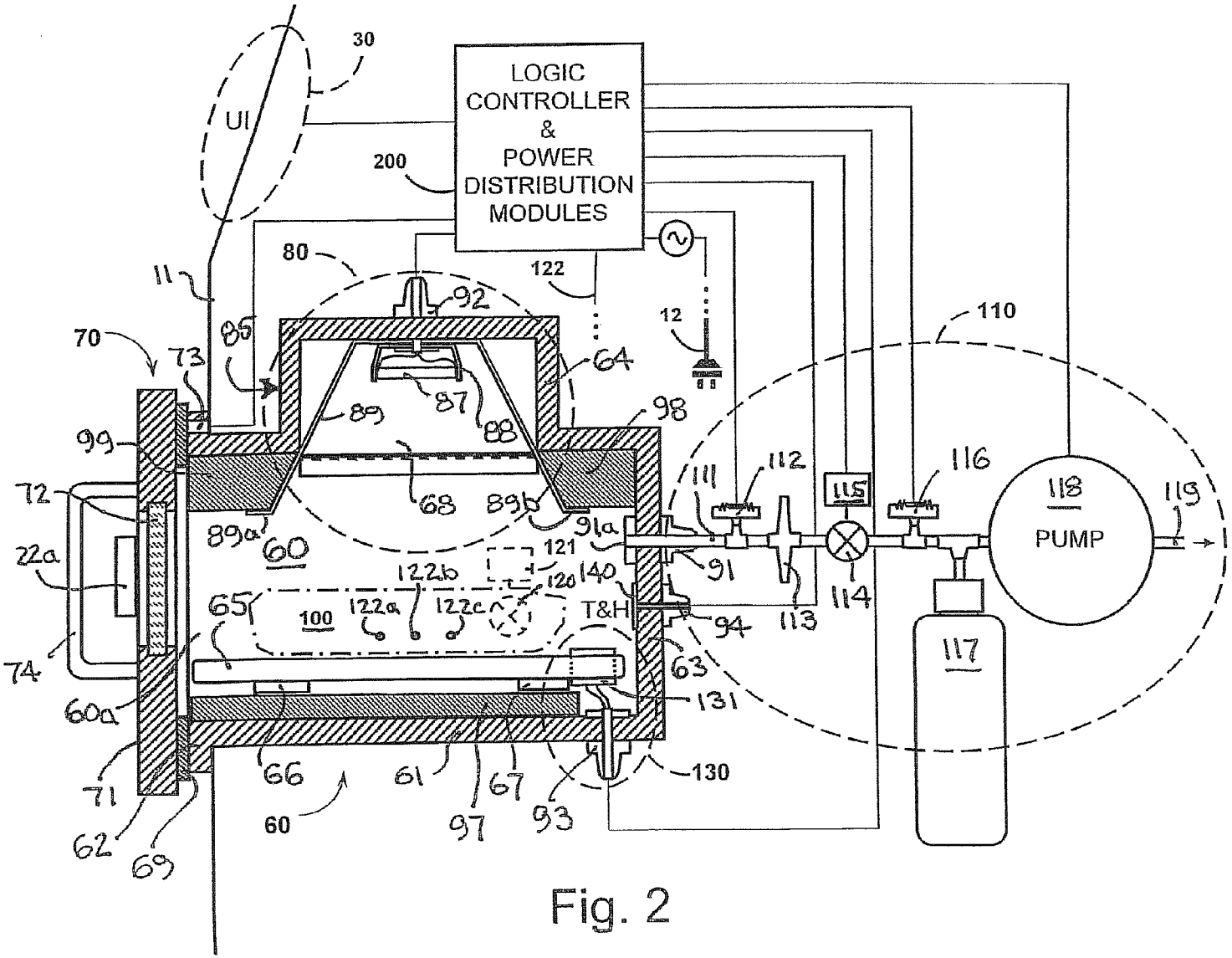
FIG. 2 is a pictorial schematic diagram of the right rescue chamber 60 of the embodiment of system 10 shown in FIG.
Figure 3:
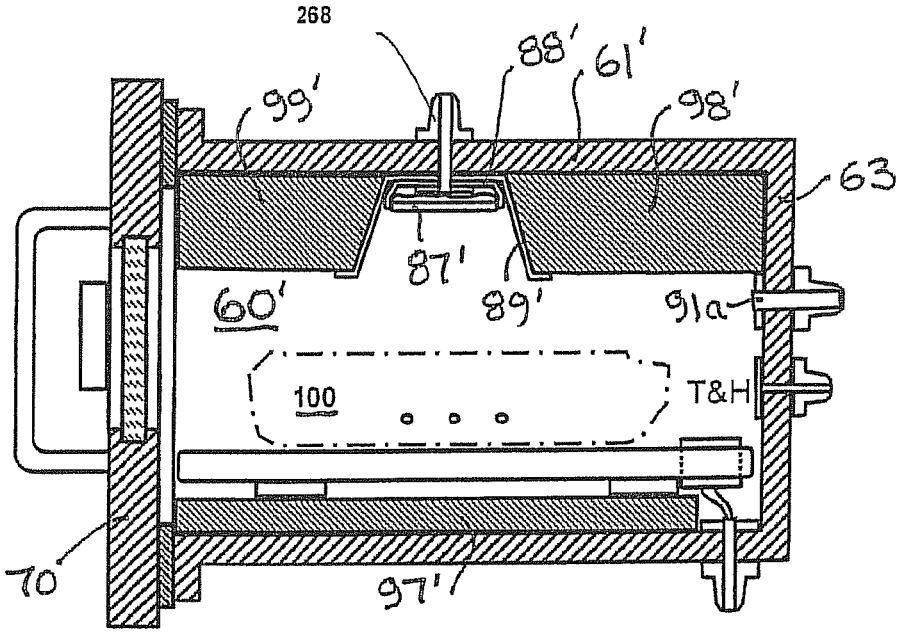

FIG. 3 is a view of the various details of chamber 60 of an alternative embodiment, shown in pictorial schematic form to match the depiction of the embodiment of FIG. 2.

Figure 4:
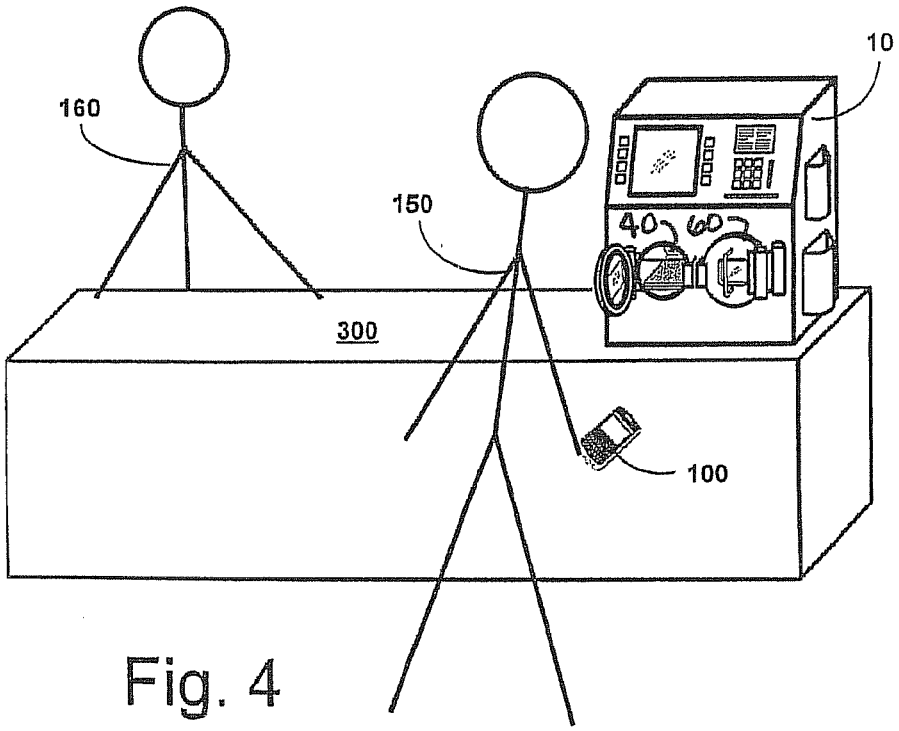

FIG. 4 is a stick-figure pictorial perspective view of a user 150 using system 10 to save an inundated handset 100, with a second person 160 watching from behind counter 300.

Figure 5:
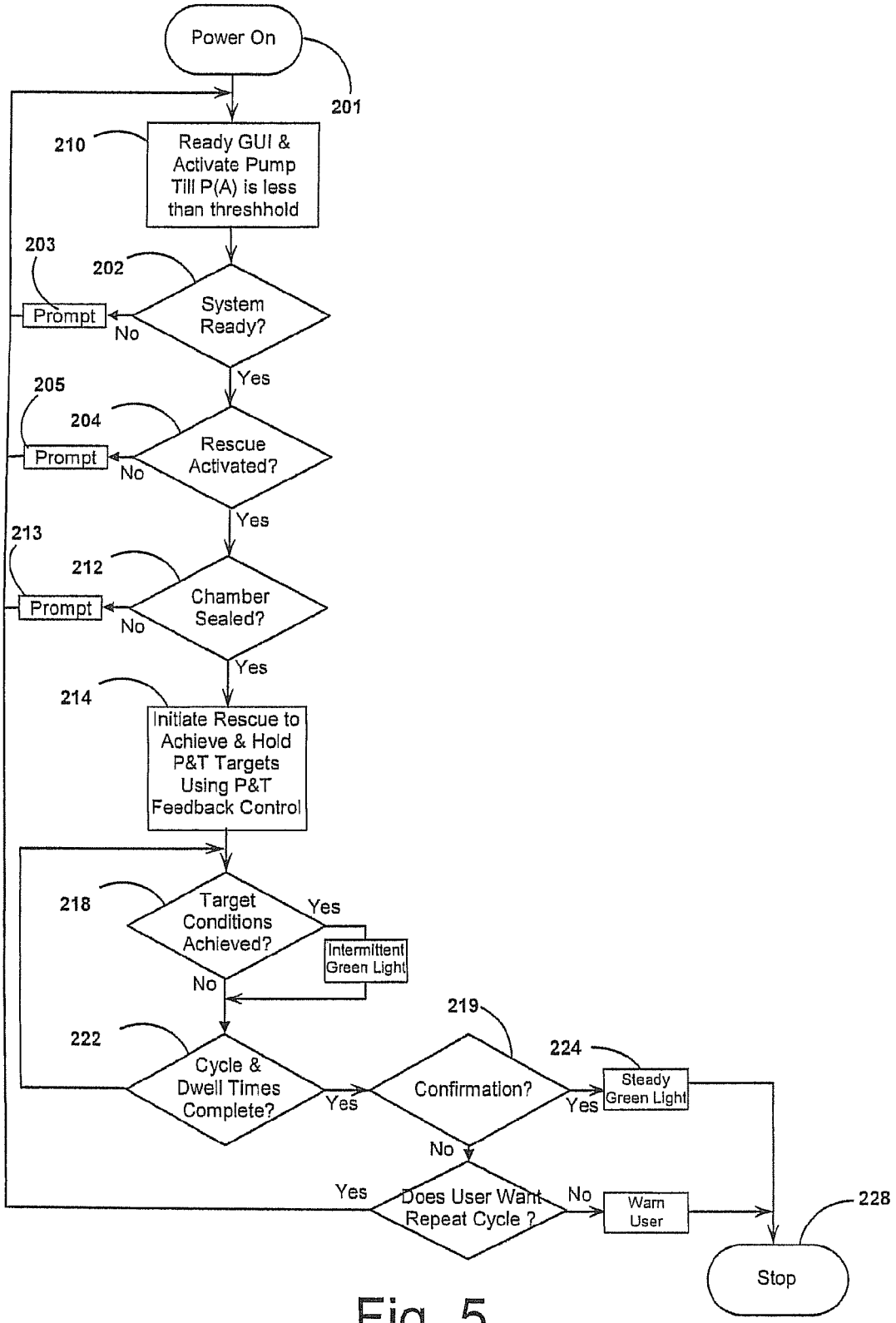

FIG. 5 is a flowchart of a particular embodiment of a method of the present invention, including numerous representative steps in the operation of the inundated handset rescue system 10.

Figure 6:
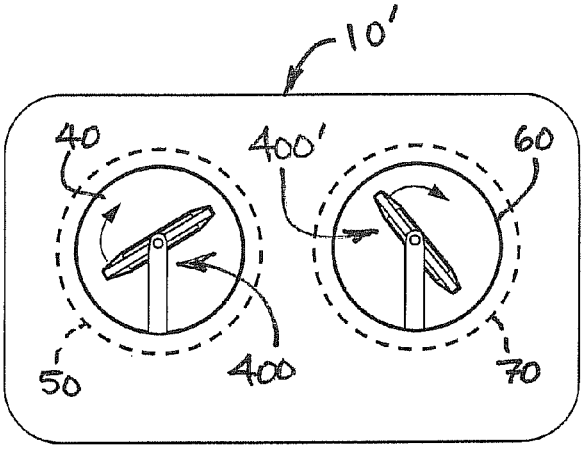

FIG. 6 is a front elevation view of an alternative embodiment 10' of rescue system 10, with the doors 50, 70 to each chamber 40, 60 shown in transparent line in order to reveal a preferred form that includes a handset agitator subsystem 400 for periodically or continuously moving handset 10 during a rescue attempt.

Figure 7:
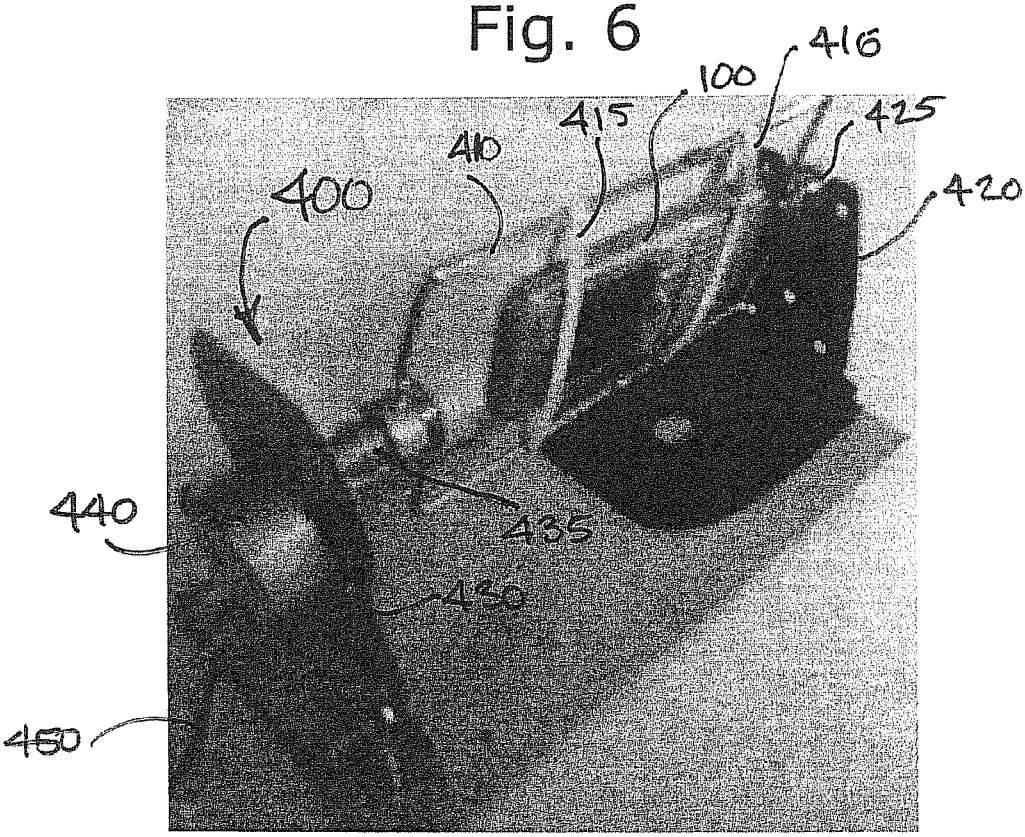

FIG. 7 is a photographic perspective view of the preferred handset agitator subsystem 400 of FIG. 6, shown separate from the other elements of alternative embodiment 10'.

DEATAILED DESCRIPTION OF PREFERRED EMBODIMENTS

An understanding of various preferred and alternative embodiments can be gleaned from a review of this description and the accompanying illustrations, wherein attempts are made to use like numerals for similar and/or analogous components from one subsystem to another and from one embodiment to another, all of which should be considered in light of the many teachings of the prior art.

Alternative preferred embodiments are occasionally described or illustrated in paragraphs, sentences or drawings that are separate from those for other preferred embodiments. Most alternative preferred embodiments, however, are described in the context of a sentence or group of sentences merely by reference to one or more alternatives for an individual component or step, as may or may not be set apart by parentheses. The reader should understand that, whenever alternative components, steps or the like are referenced in this latter manner (or in any manner), each such alternative component, step or the like may be used in virtually any combination where the other alternatives are described, illustrated or implied as being used, except perhaps to the extent that one of ordinary skill in the art would clearly recognize that such other combinations would not result in any of the structure, functionality, objectives or purposes of the present invention as ultimately claimed.

Although more detailed components are depicted in FIGS. 1-3, the basic context of typical use is depicted in FIG. 4, which uses a stick-figure pictorial perspective to show a user 150 preparing to use system 10 to save an inundated handset 100 and the data stored thereon. As shown there, a handset rescue system 10 according to the present invention is preferably embodied in a form adapted to simultaneously rescue one or multiple inundated handsets such as handset 100, in a corresponding number of rescue chambers 40, 60. Imperfect vacuum (or negative pressure) system 10 as illustrated is embodied as a self-contained, self-service unit that is configured to rest on a countertop 300, although it should be recognized that alternative embodiments may be configured as self-standing units with a base that rest directly on the floor.

While other contexts of use are also within the scope of various aspects of the present invention, countertop 300 is preferably a service counter or another countertop or tabletop in or proximate to a service department of a store involved in the retail sale of handsets. Deployment of system 10 in such proximate locations serves the compound benefits of: (a) more easily referring users 150 from the service department to the system 10 for inundated handsets 100, both to off-load service demands on personnel 160 and to generate revenue for the store (as will be described in business method contexts further below); (b) enabling automated and other referrals from system 10 to the nearby service department and/or the handset sales department of such retail store when the level of damage to inundated handsets 100 exceeds mere inundation; and (c) ensuring that trained service personnel 160 can be readily available for self-service users 150 of system 10 in the case of extraordinary needs, to the extent workflow in the service department allows.

Other modes and contexts of use may involve variations of rescue system 10 that are customized or dedicated for use behind counter 300, for use only or primarily by trained service technicians 160. Still other modes and contexts involve use of system 10 or other embodiments in the form of a countertop or self-standing handset rescue system 10 deployed much as a vending machine in a public area within proximity to one or (preferably) more than one handset service center. Such countertop or self-standing embodiments, alternatively, may be deployed within or adjacent to an establishment such as a postal center, an electronics store, a mall kiosk, a drinking establishment, or any other suitable business establishment with customer service and/or technical service representatives 160 who are often available at or near the location of system 10, to help users 150 use system 10 and/or related processes when necessary.

Despite the availability of personnel 160 in a particular context of use, system 10 preferably includes a user interface panel 30 or the like with instructions displayed thereon and/or generated through an interactive graphic user interface 31 (or other form of processionally instructive user interface). Such displayed and/or generated instructions are preferably provided processionally and in such detail as to enable system 10 to be operated on a self-serve basis, as or as though system 10 is deployed in an unmanned, unmonitored setting. An embedded processor controls a Graphical User Interface, GUI 32 and other components of a user interface panel 30 to enable user 150 to fully exercise the system 10. The GUI 32 preferably includes an interactive digital display that is friendly and robust enough to endure constant long-term use. More simple alternatives merely include simple gauges together with an assortment of lighted buttons or status indicator lights that are illuminated in one of a limited number of sequences to represent the stage in operation of system 10 at any particular point in time. Other forms of audible and visual alarms and alerts are also preferably included on panel 30 to direct user 150 appropriately during use of system 10. Irrespective of the sophisticated attributes of user interface panel 30, the presence of personnel 160 provides the benefit of helping users 150 operate system 10, as other workflow demands may allow. A timer and control switch alternative may also be included, while some preferred embodiments incorporate an integrated program timer and elapsed time indicator. Analog pressure gauges that display the pressure difference between the inner chamber and the ambient pressure may also be used as alternatives to the GUI 32.

The instructions presented by user interface panel 30 preferably include instructions that include recommended steps for preparing handset 100 for a rescue attempt. Such instructions preferably include: (1) a warning against attempting to turn on an inundated handset 100 before it is completely dry; (2) an imperative recommendation to remove the battery of an inundated handset before attempting rescue; (3) a recommendation to consider a water pre-wash of the inundated handset 100 in order to flush out any non-water solutions (such as soda, seawater or toilet water) in order to help remove bi-salts or materials that might not evaporate as readily as pure water; (4) direction to disinfect handset 100 and/or to place it in a protective pouch 101 prior to attempting rescue; and (5) a disclaimer of any supposed guarantee or promise from conducting an attempted rescue of the handset 100. Some of the same instructions, or additional instructions, are also preferably printed at a location 104 somewhere on the exterior of pouch 101, together with an image 105 that serves a trademark-like function.

The pouch 101, itself, is preferably a closeable envelope formed of highly-vapor-permeable tea-bag-like material to allow ready evaporation of moisture there through during a rescue attempt. Pouch 101 is preferably sized smaller than the dimensions within chamber 60 and yet larger than the dimensions of most handsets 100. A supply of disposable pouches 101 is preferably stored with system 10 for use by users 150. Each pouch 101 is preferably formed much like an envelope, one panel 102 that extends so that it can fold over like a flap in order to enclose the inundated handset 100 therein. A patch 103 of closure material such as an adhesive patch or a hook-and-loop fastener is preferably also integral with pouch 101 to help keep the pouch 101 closed once an inundated handset has been placed therein.

In some alternative embodiments, pouch 101 (or other components) incorporates additional disinfecting and/or drying technologies along with other aspects of the preferred embodiments. The pouch 101, for instance, in one group of preferred embodiments includes a desiccant therein, preferably within another pouch inside pouch 101, to allow for an even lower attainable humidity level during a rescue attempt and to further accelerate the rescue process. Such a desiccant feature also ensures that a level of drying takes place either before or after the actual rescue attempt in chamber 60, because a lesser level of accelerated drying is able to begin as soon as an inundated handset is placed in pouch 101. Although there are many ways of integrating desiccant technologies in system 10, another preferred alternative embodiment has an area in each chamber 40, 60 that is shaped and primarily dedicated to allow for placement of an otherwise loose bag formed of a porous net or paper-like fiber material and containing a quantity of desiccant beads. The desiccant drying system can also help enable use of less powerful vacuum and/or less powerful thermal sources, thereby reducing equipment costs, although use of such alternatives preferably involves routine replacement (or separate drying) of the desiccant bags.

Basic mechanical design and basic functionality of various preferred embodiments of system 10 can be appreciated from a review of further detail shown in FIGS. 1 and 2. As shown there, a relatively comprehensive version of system 10 preferably incorporates five basic subsystems, namely:

(1) one or more user-accessible hermetically-sealable handset rescue chambers 40, 60 together with related adaptations for receiving and supporting an inundated handset 100;

(2) a corresponding number of negative pressure subsystems 110 for delivering and maintaining controlled levels of rapid-drying subatmospheric pressure to chambers 40, 60 (i.e., an atmosphere controlled to achieve sustained vacuum gauge pressure in excess of thirty mmHg subatmospheric within chambers 40, 60);

(3) at least a corresponding number of heating assemblies 80 or 130 for delivering and maintaining safely controlled levels of rapid-drying thermal energy to chambers 40, 60 and inundated handsets 100 positioned therein, preferably in multi-modal form;

(4) a user interface panel 30 or the equivalent, preferably with one or more types of user interface modules incorporated therein with adaptations for interactive use by and for user 150; and (5) a control subsystem managed by a logic controller 200 or the equivalent, a preferred embodiment of which is illustrated in FIG. 2 simplified and combined with power distribution modules, for purposes of controlling and coordinating operation of the other subsystems to achieve and ensure the delivery and sufficiency of the overall rescue functionality provided by system 10.

Subsystems adapted to function accordingly are preferably integrated into a compact, robust, reproducible, user-friendly system that is aesthetically appealing. Adaptations are also preferably included to ensure that the system 10 is made from off-the-shelf components that are readily serviceable and easy to troubleshoot, while still fulfilling all functional requirements.

Naturally, as may be elaborated further herein, other components of preferred embodiments of system 10 may also be contemplated, many of which are crudely illustrated in the drawings, and many of which would be evident to those of ordinary skill in the art, the details of which are not as central to an understanding of the invention and/or preferred embodiments. Various forms of connectors and mounting hardware, for instance, would be used to integrate and support the various subsystems within and around the main housing 11. Tubing, conduit, manifolds, gates, switches and electrical wiring would also be included between major system components to allow them to operate in the manner described herein and to communicate both energy and data.

Although interaction with user interface panel 30 may occur first during a typical sequence of using system 10, this description focuses first on a description of the structure and function of rescue chambers 40 and 60, themselves. Alternative embodiments may only have a single chamber, but multi-chambered embodiments such as that shown in FIG. 1 are preferred, wherein each chamber 40, 60 is a separate subatmospheric pressure vessel capable of individually rescuing an inundated handset 100.

The two rescue chambers 40, 60 are preferably of similar construction relative to one another, such that a user 150 may choose to use either chamber and receive substantially similar results, while another user may use the other chamber, or user 150 may process two inundated handsets at the same or overlapping times in the two different chambers 40, 60. Given the similar aspects of chambers 40 and 60, components of chamber 60 are numbered for purposes of this description much like the numbering of the comparable components of chamber 40, with addition of twenty. For example, just as chamber 60 is numbered twenty more than chamber 40 in this description, so too, rescue platform 65 has a reference number that is twenty greater than the one for rescue platform 45, and door 70 has a reference number that is twenty greater than the one for door 50. Even though there may be incidental differences, such as hinging of doors 50 and 70 on opposite sides (door 50 being hinged on the left and door 70 being hinged on the right in FIG. 1), the reader should understand that descriptions of components of one of chambers 40, 60 apply comparably to components of the other of chambers 40, 60, as well.

With either chamber 40 or 60, preparation for delivering rescue energy to handset(s) 100 requires opening of the corresponding door 50, 70 (unless it is already open), placing the inundated handset 100 inside the chamber 40, 60, and then closing (and preferably latching) the door 50, 70 in order to seal the space within the corresponding rescue chamber 40, 60. For instance, the big arrow in FIG. 1 illustrates placement of handset 100 on platform 45 in chamber 40, while the corresponding door 50 is open. Once inundated handset 100 is in place on platform 45 (referred to as "rescue platform 45"), user 150 is preferably prompted by user interface 30 to close door 50 and to make sure that latch 21 is engaged to retain door 50 in its closed and sealed position. While the walls 61-65 of chamber 60 must be strong enough to avoid catastrophic failure when subject to the target subatmospheric pressures therein, the inner surface 60*b* of each chamber 40, 60, is preferably made of a corrosion resistant material such as stainless steel or plastic.

Inside of the chamber is a platform 45 where the handset 100 rests during a rescue attempt. Preferably, the platform is both perforated (or porous) and thermally conductive, preferably in the form of an expanded aluminum sheet, rack or mesh, supported by braces that are bonded to the interior walls 61*a* of drying chamber 60. The thermal conductivity of the rescue platforms 45, 65 serves both to help deliver heat to the handset during heating, as well as to allow it to rapidly cool (to avoid an overly hot sensation to a user's touch) when the heating cycle is discontinued. Platform 65 is preferably permanently bonded to the inner surface 61*a* of cylinder 61 by virtue of welds 66 and 67. Other methods of attachment are also known in the art, some of which would enable selective removal of platform 65 for purposes of cleaning and/or maintenance. As represented in FIG. 1 (detail omitted in FIG. 2), platforms 45 and 65 are preferably perforated or otherwise porous to minimize interference with the evaporation of water moisture from the handset 100.

Each chamber 40, 60 is sized large enough to receive an inundated handset 100 therein, preferably of a size that is large enough to accommodate at least ninety-five percent of all handset models currently being produced. At the same time, the size of each chamber 40, 60 is also not oversized in that it is preferably small enough to allow for rapid reduction of the pressure therein when a rescue attempt is initiated, to allow system 10 to achieve the target level of negative pressure for rescue in less than five minutes. Accordingly, the overall size of an annular wall 62 that defines the outer extent of chamber 60 is preferably sized to be less than eight inches in length and to have an inside diameter less than eight inches, and preferably less than six inches. In addition to (or instead of, in alternative embodiments) limiting the outer extent of chamber 60, system 10 also preferably incorporates other adaptations to reduce the sealed volume of space that is operatively sealed within chambers 40, 60, in which pressure is to be reduced during rescue. For instance, such sealed volume is preferably minimized by placing permanent (or removable) space-filling blocks such as blocks 97-99 in unnecessary open spaces within the sealed geometries of chambers 40, 60.

To enable a more effective seal and ease of opening and closing of each door 50 and 70, those doors 50, 70 are pivotally secured to front panel 20 (or associated structure) of housing 11, preferably through use of double-hinge assemblies 55 and 75, respectively. More particularly, with reference to double hinge assembly 75, each double hinge assembly 75 has a proximal hinge 76 and a distal hinge 78, the pivotal axes of which are parallel and preferably vertical. Proximal hinge 76 is permanently anchored to front panel 20 and provides for a pivotal relationship (hinged) between intermediate flange 77 and panel 20. Distal hinge 78, thence, provides for a pivotal relationship (hinged) between a distal flange 79 and intermediate flange 77, with distal flange being bolted (or otherwise rigidly and integrally joined) to the front face 71 of door 70.

With reference to door 70 of right chamber 60, as also shown in FIG. 2, each door 50, 70 is preferably provided with an integral central window 52, 72, which is generally transparent for enabling viewing of the inundated handset 100 while doors 50, 70 are closed. The transparency of window 72 generally allows viewing of handset 100 and the surrounding space in chamber 60 before, during and after the rescue process. For adequate strength and to ensure a seal over the chamber 60, window 72 is generally transparent but is strong enough to withstand the inward force induced on it by the targeted subatmospheric pressure induced within chamber 60 during rescue. To ensure adequate strength, window 72 is preferably made of ⅜" thick clear and/or reinforced shatterproof glass or acrylic (or the equivalent, or stronger). During assembly of unit 10, in order to improve the later performance of system 10, window 72 is tightly fit into a mounting slot through conventional means (not detailed), which involves use of gaskets and/or durable sealants around the perimeter of window 72.

In alternative embodiments, rather than window 72 being limited to the central region of door 70 as illustrated, the entire bulk of door 70 may be formed of transparent material in order to provide greater visibility into chamber 60 and to simplify part of the fabrication and complexity of door 70. In such alternative embodiments, despite the transparency of the bulk of door 70, it should be recognized that other related components integrally connected to door 70 may be non-transparent, preferably only to the extent they do not fully obstruct the transparency of door 70. For instance, gasket 69, hinge assembly 75, and latch 22, and the connecting bolts, adhesive or the like, may still be formed of more conventional opaque materials, with adaptations as may be conventional to accommodate the acrylic or other transparent material of door 70.

A handle 74 is also integrally mounted to protrude from the front face 71 of door 70, preferably with through-bolts (not shown) that span from the interior surface of door 70 to its outer front surface 71, preferably sealed in a manner that ensures no pressure leakage through door 70. Once rigidly and integrally mounted on front face 71 of door 70, handle 74 preferably has an orientation such that handle 74 extends outward, toward user 150 from the front face 71 of door 70 when door 70 is closed, to enable manual gripping of handle 74 for manual opening and closing of door 70 by user 150.

An annular gasket 69 is preferably provided to help complete a substantially hermetic seal within chamber 60. Gasket 69 is preferably a flat gasket having the same general shape as, albeit slightly larger than, the access opening 60' of chamber 60 and is adhered and/or otherwise affixed to the interior surface of door 70. Such gasket 69 is positioned and has properties such that a substantially hermetical seal is formed between door 70 and a matching annular surface 62 around the primary opening 60' of rescue chamber 60 when door 70 is completely closed. Plugs and other sealants are also preferably used in and/or around other ports 91-94 into chamber 60, to likewise ensure a practically hermetic seal within chamber 60 when door 70 is fully closed. As is also the case with such other plugs, gasket 69 is preferably formed of rubber or a flexible, rubber-like material, such as latex and/or tempered silicone (or the equivalent).

As an alternative to a flat gasket such as that illustrated for gasket 69, other types of seals and gaskets may also be preferred to further enable the seal around primary access opening 62. One such alternative may be in the form of an O-ring seal in a groove, or a cured silicone bead or the equivalent affixed or applied either to the inner face of door 70 or to the annular surface 62 where door 70 meets housing 11 when door 70 is in a closed position over primary access opening 60'. Another preferred alternative form of gasket 69 in alternative embodiments is in the form of an elastic gasket that captures and is held in place on the outer perimeter of door 70, in part by overlapping and embracing both the inside and outside surfaces (and the circumferential edge) of the circular perimeter of door 70, much as a tire overlaps and embraces the circular perimeter of a wheel hub. Some alternative embodiments may omit a gasket or resilient seal to the extent permitted by the scope of the claims.

After door 70 is manually closed, latch 22 is preferably provided by system 10 to keep the door 70 closed until the rescue attempt is over and user 150 knowingly releases latch 22. Preferably, latches 21 and 22 (for latching doors 50 and 70, respectively) are both centrally oriented on front panel 20, with distal pawls 21*a* and 22*a* facing laterally outward, toward hinge assemblies 55 and 75, respectively. The distal pawl 22*a* of central latch 22 is shaped and oriented to latch over a central edge of the front face 71 when door 70 is fully closed. Moreover, each such pawl 21*a*, 22*a* is preferably spring-biased laterally outward to further ensure the pawls 21*a* and 22*a* remain latched over doors 50 and 70 until user 150 (or an automated latch release actuator, as an alternative) intentionally opens latch 21, 22. Thus, latches 21 and 22 preferably ensure that the corresponding seal around doors 50 and 70—formed between the gaskets 49, 69 and the matching annular surface 42, 62 of housing 11 (or related structure) is kept substantially hermetical until the latch 21, 22 is opened to allow door 50, 70 to open in turn. To the extent permitted by the properly construed scope of original or amended claims, various features of doors 50, 70 may be omitted or substituted without materially compromising other aspects of the invention.

In the embodiment of FIG. 2, the bulk of chamber 60 is defined by cylinder 61, which is provided with an overhead infra-red source chamber 85 by welding an additional box-like enclosure sealed over an opening 68 cut into the top wall of cylinder 61 during fabrication. Alternative embodiments achieve an overall smaller volume and simplified construction for chamber 60 by mounting comparable components completely within the cylindrical perimeter of cylindrical wall 61, such as shown somewhat in FIG. 3.

In some preferred embodiments, the thermal energy source is accompanied by an ultraviolet energy source for sanitizing the handset. In such embodiments, sealed electrical port 92 of FIG. 2 (or sealed electrical port 268 of FIG. 3) allow electrical power leads to enter the chamber 60 (or 60'), and a UV bulb and associated fixtures are positioned alongside the infra-red bulb 87 (or 87'). The UV bulb (not separately shown but at the same basic location as infrared bulb 87, 87') is preferably separated from infrared bulb 87 by a thermal shield to minimize radiated heat damage from bulb 87. In such embodiments, controller 200 controls operation of the UV bulb to substantially reduce the quantity of any living microbial organisms on handset 100. The operation of the UV bulb during a rescue session preferably occurs automatically with every rescue session in order to minimize the risk of potentially infectious material on handset 100, although those of ordinary skill in the art may wish to include additional controls in order to allow selective use or non-use of UV bulb during a given rescue attempt. Irrespective of whether selected or automatic, the operation of the UV bulb may be controlled by controller 200 to occur concurrent with that of infrared bulb 87, preferably during the initial portion of a rescue attempt, such as during the first two minutes (or other duration) of a rescue attempt. Other preferred embodiments activate the UV bulb during different time periods than delivery of thermal energy, such as before or after heating, preferably before heating in order to kill microbes before pumping contaminated gases into pneumatic system 110.

For alternative embodiments, particularly for those that do not include UV bulb adaptations, instructions are preferably presented by user interface 30 directing a user 150 to clean and disinfect the handset before conducting a rescue attempt. A container of disinfectant wipes and/or solution accompanies system 10 in some alternative embodiments that do not have the UV bulb structure. Although there would be many suitable disinfectants, one such disinfectant in preferred embodiments includes a mixture of hydrogen peroxide and water in a shake bottle, for use in cleaning out the phone of pathogens.

In many preferred embodiments, in addition to the primary opening 60' of chamber 60, there are several additional sealed boreholes or comparable breaches through various walls of chamber 60. Each of such boreholes is effectively sealed prior to operation of chamber 60, with the arguable exception of subatmospheric port 91 through chamber wall 63, through which the controlled subatmospheric pressure of system 10 is delivered to chamber 60 and sustained therein during a rescue attempt, by negative pressure subsystem 110.

During each rescue attempt, negative pressure subsystem 110 is operated by controller 200 to deliver subatmospheric pressure at a target magnitude through port 91 in rear wall 63 of chamber 60 (although other suitable negative pressure ports may be positioned through other walls such as a sidewall of a cylinder 61 of chamber 60 in alternative preferred embodiments). The target magnitude for subatmospheric pressure for the present invention is different in different preferred alternative embodiments of system 10. Some alternative embodiments provide only slight levels of negative pressure, preferably at least fifty mmHg subatmospheric in one alternative embodiment, and preferably one-hundred mmHg or more in another alternative embodiment.

Embodiments with only slight levels of negative pressure are less preferred than embodiments in which negative pressure subsystem 110 is operated by controller 200 to deliver a more complete vacuum, which preferably delivers target subatmospheric pressures in excess of a half-atmosphere, and preferably in excess of five-hundred mmHg, in negative gauge pressure within chamber 60.

In preferred embodiments, the, target magnitude of subatmospheric pressure from subsystem 110 is sufficient to create an absolute pressure within chamber 60 that is less than the vapor pressure of water at the temperature of the atmosphere that is left in chamber 60. By producing such a target magnitude of subatmospheric pressure for minimum duration of time (referred to as the "dwell time"), system 10 ensures very rapid evaporation of all water moisture that may be in the inundated handset 100 in less than an hour, and typically in less than twenty minutes from the point at which the target magnitude of subatmospheric pressure is attained in chamber 60.

Preferred embodiments allow for a subatmospheric subsystem 110 that delivers significantly less than complete vacuum pressures, and accordingly also allow for less-costly and more moderate pump sizes. Such preferred embodiments allow as much by combining the negative pressure subsystem 110 with a thermal energy system, such as either or both infrared system 80 and resistive heating element 130. By combining both thermal and pressure forms of energy, subsystem 110 is preferably specified to only necessarily achieve a target magnitude of more than five-hundred but less than seven-hundred-sixty mmHg subatmospheric in chamber 60. With such specifications, subsystem 110 is able to perform with a dwell time of less than an hour while still being reliably effective at removing substantially all water moisture from inundated handset 100. Preferably, though, subsystem 110 is operably capable of delivering subatmospheric pressures of more than six-hundred mmHg subatmospheric in closed chamber 60 such that the thermal energy delivered can create temperatures of no more than 150° F. or, more preferably, 120° F. or 125° F., in the atmosphere within chamber 60, thereby minimizing the risk of material thermal damage to components of handset 100. Other preferred embodiments are specified with components of subsystem 110 such that the negative pressure subsystem is capable of delivering subatmospheric pressures of more than six-hundred-sixty-five mmHg subatmospheric to chamber 60.

One particularly preferred embodiment of subsystem 110 includes a diaphragm pump 118 that is operable to achieve 29.6 inHg (twenty nine and six tenth inches of mercury), which is more than seven-hundred-fifty mmHg subatmospheric. While oil-less pumps may be used to the extent preferred operating parameters are attainable, a particularly preferred embodiment of system 10 incorporates a two-stage, 1.5 cubic foot per minute pump for pump 118, which preferably runs on 120 VAC. Low-noise pumps are also preferred, although low-noise characteristics are not necessary for most aspects of the invention.

Negative pressure subsystem 110 principally includes the vacuum pressure string that is operatively connected to tubing 111 that extends from port 91 of chamber 60. Aside from portions of the control logic which is part of controller 200, negative pressure subsystem 110 preferably includes at least the following components: two pressure transducers 112, 116, a pneumatic line dryer 113, a normally-closed valve 114 actuated by powered actuator 115, an accumulator tank or bottle 117, pump 118 connected to serve as a vacuum pump, and conventional sealed connectors on tubing 111 between as much. With the possible exception of accumulator tank 117, each of those individual components are preferably off-the-shelf pneumatic components connected in a conventional manner for creating, sustaining and conveying subatmospheric pressure. The accumulator tank 117 may be available off the shelf, but it can be formed of almost any substantially rigid and air tight enclosure that is sufficiently strong for its purposes and is shaped to fit within the desired space in housing 11. The primary purpose of accumulator tank 117 is to accumulate subatmospheric pressure before commencement of a rescue attempt, so that the accumulated pressure can be used to speed up the process of attaining target subatmospheric pressures within chamber 60 once rescue has been initiated by controller 200.

The tubing 111 is preferably a rigid pneumatic pipe or the like, although thick-walled flexible tubing may also be used for all or part of the tubing 111 in subsystem 110 in alternative embodiments, to the extent that such tubing 111 is strong and rigid enough (or internally or externally reinforced) to avoid substantial collapse when subject to the subatmospheric pressures that are characteristic of use of system 10. When door 70 is fully closed and normally-closed valve 114 is opened by actuator 115 (under the control of controller 200), pump 118 itself serves to deliver and maintain controlled levels of rapid-drying subatmospheric pressure to chambers 40, 60 through port 91. A rapid-drying subatmospheric pressure shall be understood to be of sufficiently significant magnitude to create and sustain an atmosphere in chamber 60 that is in excess of target levels of vacuum gauge pressure, in excess of thirty mmHg subatmospheric within chamber 60.

The primary heating assembly of chamber 60 is preferably provided by overhead infra-red heating assembly 80, which serves to deliver and maintain safely-controlled thermal energy to achieve and roughly maintain a target rescue temperature within chamber 60 (preferably within +/− five degrees Fahrenheit), which correlates to an indirect target temperature within inundated handset 100. Heating assembly 80 preferably includes a 100-watt halogen bulb 87 or another form of bulb producing infrared energy at adequate levels. In some embodiments, bulb 87 (or 87') may be a conventional incandescent bulb that is controlled to deliver infrared energy at sufficient operating levels. The target rescue temperature is set by controller 200 to be sufficient for rapid-drying of handset 100, which is preferably the same as substantially complete drying of all liquid moisture in handset 100 within less than two hours and, more preferably within less than an hour or less than thirty minutes.

Even though other target temperatures may be preferred for certain applications or for use with certain specs of pump 118, the target temperature within chamber 60 is preferably at least 110 degrees Fahrenheit. In other embodiments, such target temperature is preferably at least 120 degrees Fahrenheit, but no more than 130 degrees Fahrenheit, particularly where components of handsets 100 are more susceptible to material thermal damage. Some alternative embodiments are able to achieve and sustain 125 degrees Fahrenheit or greater, while thermal controls are included to avoid the risk of sustained temperatures in the atmosphere of chamber 60 in excess of approximately 150 degrees Fahrenheit. Preferably, the maximum temperature in the atmosphere of chamber 60 is controlled to be less than the temperature at which typical inundated handsets 100 would sustain permanent material damage (i.e., melting, warping and/or other damage) if such handset 150 were to be held at that level of temperature for thirty minutes.

A thermal sensor 140 is preferably mounted in a wall 63 of chamber 60 to monitor the temperature of the atmosphere in chamber 60, to allow controller 200 to avoid excessive temperatures. A thermally-conductive goop is used around the temperature sensor 140 to make a thermal bridge to the thermally-conductive wall 63 of chamber 60, which increases the accuracy and effectiveness of sensor 140 considering air at very low pressures tends to be a partial thermal insulator. Some embodiments utilize a combined temperature and humidity sensor for sensor 140. In other embodiments, sensor 140 is or includes a thermostat, preferably a 125 degree bimetal thermostat. In still other preferred embodiments, sensor 140 has a higher temperature characteristic, preferably 140 or 150 degrees Fahrenheit, but the actual sensor 140 of such a thermostat is combined with a selectively variable resistor to enable reduction and other adjustment of its temperature reactions and, hence, the maximum temperature permitted in chamber 60.

Heating assemblies of system 10 also preferably include a resistive heating element and/or a flexible silicone heater assembly 130 for providing a second mode of delivering thermal energy to chamber 60 and/or handset 100, thereby achieving multimodal heating of the same. For these purposes, "multimodal" energy transfer is understood as being characterized by delivering such thermal energy from more than one and/or more than one type of thermal source.

As shown in FIG. 1, user interface panel 30 preferably includes both a pre-printed graphic display 31 and one or more types of powered user interface modules incorporated therein for communicative interaction with user 150. Preferably, such interface modules particularly include a graphic user interface 32 controlled by its own control module with interaction of controller 200. Graphic user interface 32 is preferably either in the form of a touch screen and/or in the form of a screen display controlled to be coordinated together with soft-programmable button selectors 33 and 34. In addition to graphic interface 32, additional data entry keys 36 are also preferably included, as is credit card reader 35 and printer 37 (represented by a slot in FIG. 1).

Control of the operation of system 10 is relatively automated and managed generally by logic controller 200 which, for purposes of this description, is referenced in a simplified and combined form to include corresponding power distribution modules and, as such, is referenced alternately as either "controller 200" or "logic controller & power distribution modules 200," or the like. As illustrated in the flow of FIG. 5, once power to the system 10 is turned "ON" through plugging in the power cord 12 and, preferably, through actuation of a power switch (not particularly shown) at initiation step 201, the automatic controller 200 directs the preparation of each negative pressure system 110 to a state of readiness for the next rescue attempt, while also monitoring user interface panel 30 for attempts by user 150 to interact with system 10. The general readiness step is indicated as step 210, specifically including readying the GUI 32 and activating pump 118. Readying of GUI 32 involves, more particularly, controlling relays and the like to distribute operative power to panel 30 and thereby initiate any dedicated user interface processors associated with panel 30.

Preparation of negative pressure system 110 particularly includes energizing and actuating pump 118 to begin reducing pressure in accumulator tank 117. While valve 114 is normally closed, virtually all pressure reduction by pump 118 is therefore directed into tank 117, while controller 200 monitors the progress toward achieving an adequate achievement of negative pressure in tank 118 through feedback from pressure transducer 116, which is in open communication with tank 117. It should be understood that the target subatmospheric pressure to be attained at transducer 116 for this readiness preparation (for reference, the "target accumulator pressure") is preferably significantly more negative than the operative subatmospheric pressure to later be targeted in chamber 60 during a rescue attempt (for reference, the "target rescue pressure"). Preferably, to achieve rapid approach to the target rescue pressure once rescue is initiated, the target accumulator pressure is at least twice the gauge magnitude of the targeted rescue pressure.

As controller 200 continues managing preparation of system 10, it continually checks readiness at query step 202 in FIG. 5. Until controller 200 determines at query 202 that both the user interface panel is ready and the target accumulator pressure is attained, controller 200 will continue causing a "Please Wait" prompt 203 to appear on GUI 32. Additionally, GUI 32 may display a recommendation for user 150 to consider a distilled water pre-wash of the inundated handset 100 in order to flush out any non-water solutions (such as soda, seawater or toilet water) in order to help remove bi-salts or materials that might increase the boiling point or not evaporate as readily as pure water. Rather than distilled water, some alternatives might include a bottle (or other source) of other liquid having known vaporization pressure characterizations that flushes out and replaces the liquid in the inundated handset 100, such that the other liquid preferably has a pH that is not harmful to standard handset electronic circuitry and components (an "approximately-neutral" pH), and the other liquid has a boiling point temperature less than that of distilled water.

Then, once system 10 is ready, processor 200 advances its query level to query step 204. Query step 204 is represented simply as "Rescue Activated" in FIG. 5. In actuality, the decision at step 204 is typically much more involved with preferred embodiments. For instance, to determine whether rescue is activated, preferred embodiments direct user 150 through a series of automated prompts, queries and disclaimers on user interface panel 30, partially in order to make sure user 150 understands the risks and prospects for use of system 10.

In addition, with self-service embodiments, electronic recognition of payment or credit must also be confirmed before rescue can be activated, through use of card reader 35 or other suitable transaction means, such as cash processors. If controller 200 determines that rescue has not been activated, prompt 205 appears on user interface panel 30 to encourage user to take actions so that rescue can be activated, or otherwise ask the user to "please wait" while query step 204 is repeated. Once controller 200 determines that rescue has been activated, processor 200 advances its query level to query step 212.

Query step 212 is intended to determine principally whether the corresponding chamber 40, 60 is adequately sealed for a rescue operation. Although more sophisticated seal verifications may be used also or in the alternative, query step 212 preferably looks at feedback from door closure switch 73 and, if switch 73 indicates door 70 is fully closed, then system 200 presumes that the chamber is adequately sealed. Although not required for all aspects of the invention, alternative embodiments also use other performance indicators to alert users (or service personnel) of inadequate seals if pressure levels are not responsive enough during actual rescue processes also. Analogous pressure tests may be part of the "Chamber Sealed?" verification process at step 212. For so long as controller 200 determines that the respective closure switch 73 is not in a door-fully-closed state, then controller 200 continues to cause prompts 213 to user 150 directing user 150 to close door 50 or 70 (or the associated latches 21, 22) or to otherwise achieve a sufficiently sealed chamber at step 212. Once query step 212 is answered affirmatively by controller 200, controller 200 causes system 10 to initiate a corresponding rescue attempt at step 214.

As indicated in FIG. 5, initiating a rescue attempt at step 214 involves commencing a rescue and then controlling the components of system 10 to rapidly achieve and then maintain (or hold) the target rescue atmosphere in the sealed chamber 40, 60 that holds handset 100. The target rescue atmosphere preferably includes maintaining a combination of a target subatmospheric pressure and a target temperature in the corresponding rescue chamber 40, 60. Commencement of rescue itself, in its simplest preferred form, involves simply energizing at least one thermal source 80, 130 and causing actuator 115 to fully open valve 114, to thereby open chamber 60 to the subatmospheric pressures accumulated in tank 117. It should be recognized, though, that a proportional valve may also be used as valve 114, to enable more sophisticated initiation and maintenance of target rescue pressure. In most embodiments, sustaining the target rescue atmosphere in the corresponding chamber 40, 60 are somewhat more complicated than just initiating rescue.

Sustaining the target rescue atmosphere in chambers 40, 60 involves controlling both pressure and temperature therein, preferably through feedback control achieved with signals from pressure transducer 112 for assessing pressure, and with signals from (Temperature & Humidity) T&H transducer 140 for assessing temperature.

Because the thermal energy is preferably provided from multimodal sources, overall control of temperature may involve modulation of only one of those sources such that one source provides a predetermined level (or profile) of thermal energy throughout the rescue attempt, whereas the other thermal source is modulated either through alternating its power distribution On and Off as appropriate, or through proportionally controlling the amount of thermal energy produced by the corresponding thermal source by varying that level of power to that source.

For instance, in a particularly preferred embodiment, the infra-red source 87 remains fully energized throughout the rescue attempt, while the level of energy provided to resistive heating element 130 is varied. Further, through careful modeling and calibration during production of system 10 (and/or through neural network learning during the course of prior rescue attempts on prior inundated handsets), the profile for controlling energy to resistive heating element 130 is maximized until the temperature monitored at thermal transducer 140 is within a first margin of the target rescue temperature. Thereafter, preferably, controller 200 distributes gradually less electrical energy to thermal source 130 as the atmospheric temperature continues approaching the target rescue temperature, with the level of energy being reduced in relation to how close the margin of separation from the target rescue chamber.

In addition to thermal feedback control through atmospheric thermal transducer 140, the resistive heating element 130 also preferably includes a thermocouple switch tied to platform 65, preferably at a location that is at least a quarter-inch away from the point of contact between platform 65 and resistive element 131. Such a thermocouple provides the added safety measure of ensuring, irrespective of the atmospheric temperature in chamber 60, that the actual temperature of platform 65 does not exceed a temperature that would cause melting or other cosmetic or other damage to outer surfaces of most known handsets 100. Hence, system 10 preferably couples atmospheric thermal feedback control together with surface temperature feedback control, in addition to subatmospheric pressure feedback control and the other controls of system 10. As an additional measure, resistive element 131 is preferably positioned relatively near to and lower than the atmospheric transducer 140, such that thermal transducer 140 tends to be somewhat sensitive to atmospheric thermal energy rising or radiating from resistive element 131.

As will be understood, once a handset rescue is commenced, controller 200 controls the thermal and negative pressure subsystems 110, 80 and 130 to (1) cause the atmospheric conditions in chamber 60 to rapidly approach the target atmosphere levels, and (2) then hold or sustain those atmospheric conditions within a relatively close margin of those target levels. Such a condition is preferably held or sustained for the duration of a predetermined time that is long enough to completely dry the electronic components of most handset models currently in production, assuming they were inundated. In a particularly preferred embodiment, such predetermined time is a standard length of time that is less than two hours in duration and, preferably, approximately thirty minutes in duration. Although some simplified embodiments may include a spring-loaded timer knob on panel 30 to control the length of time for the rescue duration, controller 200 preferably is programmed to control the therapy to last for that duration.

Throughout the duration of a rescue attempt, controller 200 also monitors the humidity in chamber 60 with a humidity sensor 140. Humidity sensor 140 may be any type of humidity transducer, but is preferably of the type that monitors both temperature and humidity. With its transducer surface positioned in (or in direct communication with) the atmosphere of the sealed space inside chamber 60, wire leads from sensor 140 are connected to convey characteristic information (either analog or digital) about the temperature and humidity of that sealed atmosphere to controller 200.

Accordingly, controller 200 is able to validate with reasonable reliability whether the rescue attempt is being successful or, at the end of the duration of a rescue attempt, whether it has likely been successful, by determining whether the remaining humidity (i.e., moisture) in the sealed atmosphere is lower than a predetermined threshold. Although other thresholds may be found to be suitable, and more reliable thresholds for particular handset models or types may be determined by testing, to be safe, the predetermined humidity threshold is preferably set to be less than five percent based on the determination that if the humidity in chamber 60 is less than that amount after handset 100 has been in sealed chamber 60 for at least thirty minutes, then any significant water in inundated handset 100 has already been removed.

Incorporating humidity feedback control into the operational logic of controller 200, with reference again to FIG. 5, until the rescue duration has concluded, at query step 218, controller 200 continually monitors the humidity and subatmospheric pressure in chamber 60 to ascertain if target conditions have been achieved. The target conditions are achieved either by (1) the humidity in chamber 60 dropping below a target humidity (which can be calibrated for dry conditions), and/or (2) reaching a target subatmospheric pressure in chamber 60, where the target subatmospheric pressure is greater than the boiling point for water at the controlled target temperature of chamber 60. Whenever the humidity in chamber 60 is below the threshold, and/or the target subatmospheric pressure is reached or exceeded, controller 200 preferably causes a green light on user interface panel 30 to blink regularly, as an indicator to user 150 that the rescue attempt in process appears to be achieving a successful rescue.

Alternatively, the controller 200 in other embodiments use algorithms to process data from other types of sensors (i.e., other than a humidity sensor 140) to validate with reasonably reliability whether the rescue attempt is likely being or likely has been successful at the end of the duration of a rescue attempt. In one such other embodiment, for instance, the system 10 is calibrated such that the controller can compare the actual time required to achieve the target level of negative pressure to an amount of time that is calibrated for achieving such target in the absence of all liquid moisture. Because Applicant has found that the presence of any liquid water in the chamber will lengthen the time for achieving the target pressure, all other factors being held constant, controller 200 is programmed to validate actual absence of liquid water in the event the actual time for target pressure is equal to or less than such a pre-calibrated amount of time. Such pre-calibrated amount of time is approximately the amount of time required to reach pressure targets for the same pump settings when a completely dry phone is in the chamber, although a slight margin of time is added to that in order to allow for imperfections. Hence, controller 200 is able to validate with reasonable reliability whether the rescue attempt is being successful even without a humidity sensor.

Thereafter, once the preset duration of the rescue attempt (preferably, thirty minutes) is complete, as determined at query step 222, controller 200 then discontinues the vacuum and thermal input into chamber 60. At confirmation query step 219 controller 200 then initiates a second verification cycle to confirm that, from a standard atmospheric pressure state (i.e. after the chamber 60 is vented), it takes less than, or approximately equal to, an expected time to re-reach the target subatmospheric pressure. This "expected time" can be calibrated (either at manufacturing or periodically during preventive maintenance) by running dry handsets through the system 10 and confirming the amount of time that it takes chamber 60 to reach the target subatmospheric pressure with a dry handset. In a preferred embodiment, the expected time is approximately two minutes, although alternative embodiments may have different expected time values, such as less than five minutes or less than one minute (as two examples). As reflected in the affirmative procession from step 219 to action step 224, if the target subatmospheric pressure is achieved within the expected time, a green light (or any alternative indicator) on user interface panel 30 is caused to change to a constant steady illumination state (or the equivalent) to indicate to user 150 that the rescue attempt appears to have been successful.

If, on the other hand, controller 200 determines at query step 219 that the target conditions have not been achieved, then the user interface preferably advises user 150 accordingly and prompts user 150 to decide whether user 150 desires to have another rescue attempt for the handset 100. If the user selects the affirmative option, then the entire process repeats. If the user instead chooses not to have another rescue attempt, then controller 200 discontinues the process and provides an audible, visual and/or printed warning that the inundated handset still appears to have water inside and that re-installing the batteries in the handset may cause permanent damage to handset 100 and/or loss of the data stored therein. If user 150 decides not to have another rescue attempt, or if the rescue attempt was successful, the system 10 reaches final step 228 and stops. In some embodiments, user interface panel 30 shows a final message to user 150 at final step 228, which may thank user 150 for using system 10; ask user 150 to come again; notify user 150 that the system 10 is now shutting down; provide user 150 with additional information for keeping their handset 100 safe; a message that benefits the retail store where system 10 is located; or any other message. While in some embodiments the system 10 will shut down at final step 228, in other embodiments, the system 10 remains powered on and ready for the next rescue attempt to speed up the process, which would be particularly useful in situations where there are multiple users 150 waiting to use system 10.

Preferably, in addition to controlling attainment of the target pressure conditions, controller 200 also controls a release—i.e., venting—of the target pressure conditions in chamber 60. Venting is performed, most notably, upon completion of a rescue attempt, to thereby allow easy opening of the door to chamber 60. The vent valve may be included in the pneumatic string of subsystem 110 in alternative embodiments, such as by using a three-way valve for valve 114 of that string.

In FIG. 2, however, vent valve 120 is shown in hidden line, behind the far sidewall 61 of chamber 60, in a configuration to vent chamber 60 through distinct venting ports 122*a*-122*c*. When valve 120 is opened under control of controller 200, valve 120 allows flow of dry air through a manifold (not shown) and into chamber 60. Due to the sudden release of subatmospheric pressure in chamber 60, the manifold preferably causes the venting dry air (or other gas such as dry nitrogen or argon from a dedicated source of the same) to be directed as small jets of air blowing into chamber 60 through a series of vent ports 122*a*-122*c* pointing toward the typical position where handset 100 is positioned.

Controlled venting in multiple cycles also maximizes removal of moist gases from chamber 60, preferably by plumbing the feed line for valve 120 into a location adjacent to, or preferably directly above, thermal subsystem 80. With the feed line for valve 120 so positioned, the air used for venting is more likely to be relatively hot and dry. Moreover, by venting such relatively hot and relatively dry gas into chamber 60 at intervals, the most rapid amount of drying can be achieved.

Such a venting process is preferably automatically repeated under control by controller 200 at least twice during a given rescue attempt, to further enhance drying and cause circulation of vented dry gas through directed cross-flow, to flush more moisture out of handset 100. Use of the vent valve 120 also serves as a way to jet air through the small vent holes 120*a*-*c* directly on the handset 100 before starting a second rescue attempt. Alternative devices such as miniature fans may also be incorporated in alternative embodiments to enhance movement of moisture out of chamber 60. Preferably, vent valve 120 is a normally-open valve such that it is closed when power is distributed to operate a rescue attempt and such that it fails open in the event of a power failure, to ensure access to a handset left in chamber 60.

Alternatively, while the system is running, the GUI 32 will monitor the relative humidity within the chamber and either after a predetermined amount of time or when the relative humidity falls below a predetermined threshold, the system will shut off and the user may then retrieve their rescued handset.

It should be recognized that controller 200 is preferably embodied to include one or more embedded interacting general purpose or special purpose microprocessors (or other forms of data and/or logic processors) that are programmed or otherwise adapted, preferably including the incorporation of functional software code on machine-readable storage medium, to become adapted for the special purposes and functionality that are described herein, as well as for such other incidental and ancillary purposes and functionality as one of ordinary skill in the art would understand should also be addressed by such software and other adaptations. In addition to adaptation through software programming of data processors, it should also be understood that controller 200 is preferably embodied to include one or more interacting printed circuit boards. Moreover, the above-referenced processors are preferably functionally integrated in or peripheral to such printed circuit boards, together with related electronic components and connecting circuitry that may be necessary or expedient for accomplishing the purposes and functionality of controller 200, especially as relates to controlling and coordinating operation of the other subsystems of system 10 to achieve and ensure the sufficiency of the overall rescue functionality provided by system 10. It should also be recognized that various controllers that make up controller 200 communicate with each other and with the connected sensors and controlled subsystems through any suitable means, whether through analog or digital wire-line communications or through wireless communication, preferably through use of known communication protocols.

The number of rescue assemblies in a given assembly 10 or location can vary depending on the need, although more than one chamber per system 10 is preferred in typical commercial environments so that at least a second rescue process can be commenced while another is still in process. The operator interface 30 preferably contains subset portions of the electronic controller subsystems 200. The actual locations of the electronic controller 200 as well as the locations, types, and number of sensors can vary in alternate embodiments of the invention. Additionally, alternate embodiments can substitute assemblies for the upper and lower rescue assemblies as well as vary the number of such assemblies. Such alternatives should fall within the scope of some (but not necessarily all) aspects of the present invention, except to the extent clearly excluded by the claims.

Controller 200 also includes user interface program(s) and controller/processor program(s) which control the electromechanical operation of the preferred embodiment. In some preferred embodiments, a set of one or more lighted indicators are provided on user interface panel 30, each set corresponding to each chamber 40, 60, to indicate one or more states that relate to the operation of the respective chambers 40, 60 or the conditions therein. Such lighted indicators are preferably in positions that allow easy visual correlation to each chamber 40 and 60, such as in positions that are generally directly above the corresponding chambers 40, 60. In operation, controller 200 causes such indicator lights to be illuminated to indicate states of operation of system 10 such as the stage(s) of operation of system 10 or whether threshold conditions have been attained in the corresponding chamber 40, 60. The blue button (pressure attained) is used as an indicator for indicating one of two states to a user, said state being a state of completion of said effective duration and/or a state of effectiveness of the operation of the system; and one or more controllers for serving operative functions while said door is closed and said seal is created, said functions including (i) causing said negative pressure system to operatively produce said negative pressure atmosphere in said chamber, (ii) causing said thermal energy system to operatively deliver said thermal energy, (iii) monitoring said sensor, and (iv) operatively controlling said indicator.

In still other alternative embodiments, further adaptations are made to enhance optimal pressure and temperature control. Even more speed for rescue is attained in some embodiments through controlled preheating of a thermal sink (not shown). Controls are also programmed into controller 200 to allow for predictive thermal ramping using T-sensor 140 feedback, to reduce delta-T as the rescue platform temperature and/or the atmosphere in chamber 60 approaches the target temperature. Until the temperature is close to the target, the power to the respective thermal units is maximized for fastest rate of heating, preferably until a first thermostat switch reaches its set temperature threshold. Thereafter, the energy to (and likewise from) the respective thermal energy units is preferably operated intermittently and modulated at half power to more carefully approach and sustain the target conditions. Manual options may also be substituted, such as through use of variable resistors/rheostats in order to manually modulate the rate at which the target temperature and/or pressure are approached.

The various subsystems of system 10 are preferably operatively integrated, mounted and housed with an outer housing 11 such as shown in FIG. 1. Housing 11 is preferably formed of polished, stainless, and/or otherwise painted or finished sheet metal (or other suitable material) that is cut, stamped, bent, welded or otherwise joined and finished to form a suitable shape and structure for outer housing 11. Other structural elements (not generally shown) are also preferably included within and joined to housing 11 to provide strength and rigidity for housing 11 and the subsystems supported therein.

Although not critical to various aspects of the invention, in some embodiments, housing 11 also preferably includes a small bin 26 and a large bin 27 formed integrally with a panel such as side panel 25 of housing 11. It should be recognized, though, that the relative sizes of such bins may well be a matter of choice. Each such bin 26, 27 preferably serves functionality ancillary to operation of system 10, and is preferably formed to have an open upper end 26*a*, 27*a* and a closed lower end 26*b*, 27*b*. In at least one embodiment, bin 26 serves as a dispenser for disposable components required for certain modes of use of system 10, such as sealable plastic bags 101 in which inundated handsets 100 may be placed during and/or after rescue by system 10. Indeed, one embodiment is adapted to induce the said subatmospheric pressure atmosphere to an inundated handset 100 while it is positioned within such a sealable bag 101 and to seal (or allow sealing) of such bag 101 in a manner that sustains the subatmospheric pressure in such bag 101 after the bag 101 with its enclosed handset 100 is removed from chambers 40, 60.

Bin 27 is provided with accompanying labeling (not shown) to invite customers to deposit inundated handsets 100 into bin 27 (such as through open end 27*a*). Preferably, the designated purpose for inviting such deposit is for purposes of deferred rescue or for recycling or other processing of an inundated handset 100. Such deferred rescue or other processing is particularly beneficial, for instance, if user 150 is not able to use system 10 at the time of deposit, or if an attempted rescue by system 10 is not successful for handset 100.

It should be understood that the componentry layout as illustrated in FIG. 2 is simplified for purposes of illustration. Instead, as will be evident to those of skill in the art, preferred embodiments allow numerous bends, supports, brackets, mounts, insulators, packing foam, noise suppressors, bonding agents, adjustments, secondary elements, and the like in order to achieve overall functionality and secondary purposes such as optimizing space and other well-known considerations in the design of such systems.

In an exemplary embodiment, the present invention provides a convenient, accurate way for controlling rescue. The present invention preferably provides such a method in the form of a microprocessor controlled vacuum drying chamber uniquely adapted for rapidly rescuing handsets without melting or otherwise damaging components. The present invention is directed to a method of accelerating, and indicating to the user whether the process is likely to have achieved an adequate level of drying and whether further precautionary measures are recommended to preserve the handset 100 and/or data that may be stored thereon.

Many other objectives, features, advantages, benefits, improvements and non-obvious unique aspects of the present invention, as well as the prior problems, obstacles, limitations and challenges that are addressed, will be evident to the reader who is skilled in the art, particularly when this application is considered in light of the prior art. It is intended that such objectives, features, advantages, benefits, improvements and non-obvious unique aspects are within the scope of the present invention, the scope of which is limited only by the claims of this and any related patent applications and any amendments thereto.

To the accomplishment of all the above and related objectives, it should be recognized that this invention may be embodied in the form illustrated in the accompanying drawings, attention being called to the fact, however, that the drawings are illustrative only, and that changes may be made in the specifics illustrated or described.

Preferred embodiments comprise a box 11 into which the inundated handset 100 can be placed and hermetically sealed. Inside the hermetically sealed box 11 preferably is a porous rescue platform 45 on which the inundated handset 100 is positioned to receive controlled levels of negative pressure coupled with thermal energy, preferably from multimodal sources. The thermal energy delivery preferably includes energy from one or more infrared heat lamp(s) to help heat up the atmosphere in the chamber 40 so that the moisture in the electronics device can be driven into the vapor phase, and the vacuum pump 118 is used to reduce the gauge pressure in the chamber 40 and to pump out the vapor. As this concept is applied to inundated handsets 100 over a duration that corresponds to a rescue attempt, ultimately all the moisture in the electronics device 100 should be driven out and pumped out of the chamber. A temperature and moisture sensor 140 is preferably incorporated to track the relative changes in humidity within the pressure vessel. When the relative humidity falls below a predefined threshold, this should mean the inundated handset 100 is now dry.

Preferably, when the user closes the door to the chamber and activates the drying cycle, via a touch based graphical user interface (GUI) 32, the program sends digital signals over a universal serial bus (USB) to a multifunction data acquisition (DAQ) device. This device engages two solid-state high current relays that provide power to both the roughing pump and a flexible silicone resistive heating element (attached to the rear inside wall of each pressure vessel). Wired in series with this heating element will be a bimetal thermal sensor 140 which opens the circuit when the sensor gets above a predetermined set point and closes the circuit when the temperature cools below a predetermined threshold.

In addition to thermal controls that serve to minimize excessive heating, preferred embodiments also include other control systems to help ensure that adequate drying has occurred before discontinuing a drying cycle or, if adequate drying is not obtained after an extended period of time, preferably after sixty minutes of drying cycle operation, to alert the user 150 accordingly, such that the user 150 can make further drying attempts before risking damage by prematurely re-powering the handset 100.

As shown in FIGS. 6 and 7, some alternative embodiments also incorporate a handset agitation systems 400 that functions to occasionally or continuously move the handset 100 in order (1) to drain or otherwise promote movement of liquid water to other locations within handset 100 in order to encourage additional vaporization of such water, and/or (2) to more evenly distribute the application of thermal energy on all surfaces of handset 100. This agitation subsystem 400 may come in a number of forms that would cause the desired movement of handset 100 while it is undergoing a rescue attempt.

The agitation subsystem variation shown in FIGS. 6 and 7 provides a gradual, continuous rotation of handset 100 (preferably less than five rpm, and preferably about two rpm) about an axis of rotation that extends through rotary shafts 435 and 425, which is concentric with the respective cylindrical chamber 40, 60, much like a rotisserie would achieve in a food cooking application. As is evident, handset 100 is held in place on a rotating rack or platform by bands, which may be elastic bands. That rotating rack is connected to shaft 435, which is supported rotationally in the bearing of an end support 430 that is oriented in the rear of chamber 40, 60, while shaft 425 is supported rotationally in the bearing of an end support 430 that is oriented in the rear of chamber 40, 60. As shown, motor 440 may be powered whenever power is distributed to the thermal source 87, thereby ensuring that thermal energy is distributed more evenly on all surfaces of handset 100 whenever such energy is being radiated from source 87. In one such configuration, the pump 118 is a 120 VAC multistage (i.e., two- or three-stage) pump (preferably oil-less, in order to reduce maintenance) that is capable of pumping 1.5 cubic feet per minute and achieving 29.5 inches of mercury vacuum within chambers 40, 60.

Other alternative embodiments of agitation subsystem 400 may be substituted in a form that more-aggressively causes acceleration G-forces to act on water inside handset 100. For instance, embodiments with a similarly rotational mount in chamber 40, 60 can achieve much faster rotation (more than 200 rpm and, preferably, about 800 rpm) in order to produce centrifuge like G-forces, to achieve even faster drying. Still others may achieve a linear agitation (as opposed to rotary agitation), as will be evident to those of skill in the art.

Through convenient access and use, some preferred embodiments help to make the handset recovery process more accessible to a greater number of handset users 150, thereby enabling peace of mind that an attempt to salvage the handset 100 has been made even if the handset 100 or its data are, in fact irretrievable. By partnering with wireless telecommunications carriers and/or shipping services, some preferred embodiments ensure availability of a rapid-handset-drying alternative through attractive business arrangements that compensate such partners with bonus fees that increase relative to the amount of revenue-generating use for the particular handset recovery station, in addition to reasonable flat fees. Some embodiments also generate revenue through referral services and/or advertising displays that provide handset users with information about other handset options, carrier options and/or handset service options, preferably in the general vicinity of each particular handset recovery station. By delivering an automated rescue system 10 that routinely completes a rescue attempt in less than an hour (or, more preferably, less than thirty minutes), and by doing so in a retail business setting that commercialized other products (such as phones, electronics and accessories, potential purchasers are likely to remain in the sales setting while waiting for the rescue attempt to be completed, thereby increasing the likelihood of incidental purchase transactions for that setting. Preferred embodiments work to educate handset users 150 on best practices for safe and effective use of handsets 100. Other objectives of the invention involve improving over the state of the art, and providing such systems and methods together with business methods and accommodations that will allow successful and sustainable implementation in the marketplace. Related business methods of preferred embodiments derive revenue through licensing and marketing agreements with service center owners or the operators of other retail establishments such as courier mail centers. Whether now known or later discovered, there are countless other alternatives, variations and modifications of the many features of the various described and illustrated embodiments, both in construction and in operation, that will be evident to those of skill in the art after careful and discerning review of the foregoing descriptions, particularly if they are also able to review all of the various systems and methods that have been tried in the public domain or otherwise described in the prior art. All such alternatives, variations and modifications are contemplated to fall within the scope of the present invention. Although the present invention has been described in terms of the foregoing preferred and alternate embodiments, this description has been provided by way of explanation of examples only and is not to be construed as a limitation of the invention, the scope of which is limited only by the claims of any related patent applications and any amendments thereto.

Alternative embodiments of certain aspects of the present invention also include adaptations of the methods and systems described above, such as adaptations to be used for providing a straightforward method and system by which a user 150 can attempt to rescue a handset 100 and determine whether the attempt is likely to have succeeded. Such alternatives include comparable adaptations such that drying will likely be accelerated. While the various particular steps that would be useful in determining whether a handset 100 has been adequately dried may vary depending on the specific handset 100 model and the circumstances and extent of its inundation, it will be evident to those of skill in the art whether and how systems and methods of the present method can be adapted for use with any particular inundated handheld device 100.

Specific details are given in the above description to provide a thorough understanding of various preferred embodiments. However, it is understood that these and other embodiments may be practiced without these specific details. For example, components, circuits or processes may be shown in block diagrams in order not to obscure the embodiments in unnecessary detail. In other instances, well-known processes, algorithms, structures, and techniques may be shown without unnecessary detail in order to avoid obscuring the embodiments.

Implementation of the techniques, blocks, steps and means described above may be done in various ways. For example, these techniques, blocks, steps and means may be implemented in hardware, software, or a combination thereof. For a hardware implementation, the processing units may be implemented within one or more application specific integrated circuits (ASICs), digital signal processors (DSPs), digital signal processing devices (DSPDs), programmable logic devices (PLDs), field programmable gate arrays (FPGAs), processors, controllers, macro-controllers, microprocessors, other electronic units designed to perform the functions described above, and/or a combination thereof.

Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be rearranged. A process is terminated when its operations are completed, but could have many additional steps not included in the figure. A process may correspond to a method, a function, a procedure, a subroutine, a subprogram, etc. When a process corresponds to a function, its termination corresponds to a return of the function to the calling function or the main function.

Embodiments of the invention may involve use of a portable user interface that is adapted to provide or allow continuous or intermittent secure links with the facility network 400. For a middleware and/or other software implementation, the methodologies may be implemented with modules (e.g., procedures, functions, and so on) that perform the functions described herein. Any machine-readable medium tangibly embodying instructions may be used in implementing the methodologies described herein. For example, software codes may be stored in a memory. Memory may be implemented within the processor or external to the processor and may be downloadable though an interne connection service. As used herein the term "memory" refers to any type of long term, short term, volatile, nonvolatile, or other storage medium and is not to be limited to any particular type of memory or number of memories, or type of media upon which memory is stored.

Moreover, as disclosed herein, the term "storage medium" may represent one or more memories for storing data, including read only memory (ROM), random access memory (RAM), magnetic RAM, core memory, magnetic disk storage mediums, optical storage mediums, flash memory devices and/or other machine readable mediums for storing information. The term "machine readable medium" includes, but is not limited to, portable or fixed storage devices, optical storage devices, wireless channels, and/or various other storage mediums capable of storing that contain or carry instruction(s) and/or data.

Furthermore, embodiments may be implemented by hardware, software, scripting languages, firmware, middleware, microcode, hardware description languages, and/or any combination thereof When implemented in software, firmware, middleware, scripting language, and/or microcode, the program code or code segments to perform the necessary tasks may be stored in a machine readable medium such as a storage medium. A code segment or machine-executable instruction may represent a procedure, function, subprogram, program, routine, subroutine, module, software package, script, class, or any combination of instructions, data structures, and/or program statements. A code segment may be coupled to another code segment or a hardware circuit by passing and/or receiving information, data, arguments, parameters, and/or memory contents. Information, arguments, parameters, data, etc. may be passed, forwarded, or transmitted via any suitable means including memory sharing, message passing, token passing, network transmission, etc.

In the appended figures, similar components and/or features may have the same reference label. If only the first reference label is used in the specification, the description is applicable to any one of the similar components having the same first reference label irrespective of the second reference label.

While the principles of the disclosure have been described above in connection with specific apparatuses and methods, it is to be clearly understood that this description is made only by way of example and not as limitation on the scope of the disclosure. Whether now known or later discovered, there are countless other alternatives, variations and modifications of the main features of the various described and illustrated embodiments, both in the process and in the system characteristics, that will be evident to those of skill in the art after careful and discerning review of the foregoing descriptions, particularly if they are also able to review all of the various systems and methods that have been tried in the public domain or otherwise described in the prior art. All such alternatives, variations and modifications are contemplated to fall within the scope of the present invention.

Although the present invention has been described in terms of the foregoing preferred and alternative embodiments, these descriptions and embodiments have been provided by way of explanation of examples only, in order to facilitate understanding of the present invention. As such, the descriptions and embodiments are not to be construed as limiting the present invention, the scope of which is limited only by the claims of this and any related patent applications and any amendments thereto.

I claim:

1. A system for rapidly drying inundated wireless telecommunications handsets, comprising:

a housing defining one or more chambers for receiving an inundated wireless telecommunications handset, said one or more chambers enclosing a space around a surface, said space being sized and shaped to receive a wireless telecommunications handset therein, said surface being positioned to support an inundated handset within said one or more chambers, and said one or more chambers being sealable to create a seal for sustaining a negative pressure atmosphere in said space in excess of a threshold for at least an effective duration of time in excess of twenty minutes;

a negative pressure system for producing said negative pressure atmosphere in said space at magnitudes equal to or greater than said threshold, said threshold being equal to or greater than 30 mm Hg gauge pressure;

said housing having a door for each of said one or more chambers for opening access to said one or more chambers, said door being positionable in at least two positions, including an open position for opening external access to said one or more chambers to allow placement of said inundated handset on said surface in said one or more chambers, and including a closed position for closing external access to said one or more chambers and enabling said seal;

said surface comprising a thermal energy system for delivering thermal energy to a handset in said space, said thermal energy system comprising an electrical resistive heating element;

one or more sensors for directly or indirectly monitoring one or more conditions in said space;

an indicator for indicating a state to a user, said state being a state of completion of said effective duration and/or a state of completion of the operation of the system;

one or more controllers for serving operative functions while said door is closed and said seal is created, said functions including (i) causing said negative pressure system to operatively produce said negative pressure atmosphere in said chamber, (ii) causing said thermal energy system to operatively deliver said thermal energy, (iii) monitoring said one or more sensors, and (iv) operatively controlling said indicator;

an interface module having a display screen for communicative interaction with a user of said system; and a mechanism for accepting payment by a user of said system.

2. The system of claim 1, wherein said negative pressure system comprises:

an airflow conduit in fluid communication with said chamber for directing air from said chamber into and through said negative pressure system;

one or more pressure transducers configured for measuring the pressure within said negative pressure system and providing feedback to said one or more controllers;

one or more valves configured for regulating airflow through said negative pressure system;

an actuator for opening and closing said one or more valves, said actuator being controlled by said one or more controllers;

a tank in fluid communication with said one or more pressure transducers, said tank being configured for accumulating subatmospheric pressure; and a pump in fluid communication with said chamber and said tank, said pump being configured for reducing pressure in said tank.

3. The system of claim 2, wherein said airflow conduit comprises a rigid pneumatic pipe, said pipe being sufficiently inelastic such that said conduit does not collapse when exposed to subatmospheric pressures present with said negative pressure system.

4. The system of claim 2, further comprising a dryer in fluid communication with said airflow conduit, wherein said dryer is positioned in-line with said airflow conduit, and wherein said dryer is configured for removing vapor from said airflow conduit.

5. The system of claim 1, wherein said wireless communication handset is securably attached to said surface, and wherein said surface is rotatable about an axis.

6. The system of claim 1, further comprising a container for accepting said inundated handset, whereby said container encloses said inundated handset within said chamber.

7. The system of claim 6, wherein said container comprised a closable pouch having sufficient size to fully enclose said handset, and wherein said pouch is comprised of vapor-permeable material.

8. The system of claim 7, wherein said pouch includes a container within said pouch, said container having a quantity of desiccant material contained therein.

9. The system of claim 1, further comprising a container with said chamber, said container comprising a porous material, wherein a quantity of desiccant material is contained therein.

10. The system of claim 1, wherein said door is hingedly connected to said housing, said door having a mechanical seal affixed on an inner surface of said door for effecting a seal between said door and said chamber when said door is in a closed position.

11. The system of claim 1, wherein said interface module comprises a graphic user interface, and wherein said display of said interface module is a touch-screen for allowing a user of said system to communicatively interact with said system.

12. The system of claim 1, further comprising an energy source for disinfecting said handset when said handset is positioned on said surface within said chamber.

13. The system of claim 12, wherein said energy source comprises an ultraviolet light source.

14. The system of claim 1, wherein said one or more sensors comprises a thermal sensor in fluid communication with said one or more chambers, said thermal sensor configured for monitoring temperatures within said one or more chambers during operation of said system.

15. The system of claim 1, wherein said one or more sensors comprises a combination temperature and humidity transducer in fluid communication with said one or more chambers, said transducer configure for monitoring the temperature and humidity with said one or more chambers during operation of said system.

16. The system of claim 1, further comprising:

a vent valve having one or more internal ports in fluid communication with said one or more chambers, said vent valve being actuatable to release said negative pressure and to vent air into said one or more chambers through said one or more internal ports and across said inundated wireless communications handset; and wherein said one or more controllers are further adapted to control actuation of said vent valve.

17. The system of claim 1, wherein said payment mechanism comprises a credit card reader.

18. A method of operating a system for rapidly drying an inundated wireless telecommunications handset, said method comprising:

placing an inundated wireless telecommunications handset onto a surface located within a chamber of said system;

reducing atmospheric pressure within said chamber;

heating said chamber and said wireless telecommunications handset with a thermal energy source;

controlling the reduced pressure and increased temperature conditions with one or more controllers;

providing said one or more controllers with feedback relating to pressure and temperature during drying; and maintaining reduced pressure and increased temperature conditions until said wireless telecommunications handset is dry.

* * * * *